US009408004B2

(12) United States Patent
Higgins et al.

(10) Patent No.: US 9,408,004 B2
(45) Date of Patent: Aug. 2, 2016

(54) FLEX CONNECTOR FOR A HEARING ASSISTANCE DEVICE

(71) Applicant: Starkey Laboratories, Inc., Eden Prairie, MN (US)

(72) Inventors: Sidney A. Higgins, Maple Grove, MN (US); Gary Zajicek, Waconia, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 300 days.

(21) Appl. No.: 13/889,227

(22) Filed: May 7, 2013

(65) Prior Publication Data

US 2013/0294628 A1 Nov. 7, 2013

Related U.S. Application Data

(60) Provisional application No. 61/643,861, filed on May 7, 2012.

(51) Int. Cl.
*H04R 25/00* (2006.01)

(52) U.S. Cl.
CPC ..... *H04R 25/556* (2013.01); *H04R 25/608* (2013.01)

(58) Field of Classification Search
CPC .... H04R 25/60; H04R 25/658; H04R 25/602; H04R 25/608; H04R 1/1058; H04R 25/556; H05K 1/189; H05K 1/118; H05K 3/303; H05K 1/0393; H05K 2201/10189; H05K 3/361; Y10T 29/49572; H01R 12/592; H01R 12/62; H01R 43/00; H01R 4/027
USPC ..... 381/312, 322, 324, 323, 328; 181/129, 181/130, 135
See application file for complete search history.

(56) References Cited

U.S. PATENT DOCUMENTS

| | | | | |
|---|---|---|---|---|
| 5,701,348 | A | 12/1997 | Shennib et al. | |
| 6,456,720 | B1 | 9/2002 | Brimhall et al. | |
| 6,617,518 | B2 * | 9/2003 | Ames | H01R 12/592 174/254 |
| 7,443,992 | B2 | 10/2008 | Fideler | |
| 8,218,803 | B2 | 7/2012 | Fickweiler et al. | |
| 8,428,280 | B2 | 4/2013 | Cheng et al. | |
| 8,682,016 | B2 * | 3/2014 | Wagner | H04R 25/602 181/130 |
| 8,761,423 | B2 * | 6/2014 | Wagner | H04R 25/602 381/322 |
| 2005/0286731 | A1 | 12/2005 | Shennib et al. | |
| 2007/0177749 | A1 | 8/2007 | Sjursen et al. | |
| 2007/0229369 | A1 * | 10/2007 | Platz | H01Q 1/085 343/702 |
| 2010/0158294 | A1 | 6/2010 | Helgeson et al. | |

OTHER PUBLICATIONS

"European Application Serial No. 13166855.0, Extended European Search Report mailed Jul. 2, 2013", 6 pgs.

(Continued)

*Primary Examiner* — Davetta W Goins
*Assistant Examiner* — Phylesha Dabney
(74) *Attorney, Agent, or Firm* — Schwegman Lundberg & Woessner, P.A.

(57) ABSTRACT

The present disclosure relates to improved receiver connectors for hearing assistance devices. One aspect of the present subject matter relates to a hearing assistance system including a flex connector. A hearing assistance device housing includes hearing assistance electronics for a hearing assistance device. The system also includes a receiver configured to convert an electrical signal from the hearing assistance electronics to an acoustic signal. The receiver is configured to enable a quick connect and disconnect at various degrees on and off vertical axial alignment with repeatable reliability, according to various embodiments.

22 Claims, 4 Drawing Sheets

(56) References Cited

OTHER PUBLICATIONS

"European Application Serial No. 13166855.0, Office Action mailed Jul. 24, 2014", 4 pgs.

"European Application Serial No. 13166855.0, Response filed May 12, 2014 to Extended European Search Report mailed Jul. 2, 2013", 11 pgs.

"European Application Serial No. 13166855.0, Response filed Feb. 2, 2015 to Office Action mailed Jul. 24, 2014", 7 pgs.

* cited by examiner

FLEX CONNECTOR FOR A HEARING ASSISTANCE DEVICE

CLAIM OF PRIORITY

The present application claims the benefit under 35 U.S.C. §119(e) of U.S. Provisional Patent Application Ser. No. 61/643,861, filed on May 7, 2012, which is incorporated herein by reference in its entirety.

FIELD OF THE INVENTION

The present subject matter relates generally to hearing assistance devices, and in particular to a flex connector for a hearing assistance device.

BACKGROUND

Modern hearing assistance devices, such as hearing aids, typically include digital electronics to enhance the wearer's listening experience. Hearing aids are electronic instruments worn in or around the ear that compensate for hearing losses by specially amplifying sound. Hearing aids use transducer and electro-mechanical components which are connected via wires to the hearing aid circuitry. In addition to transducers, modern hearing assistance devices incorporate A/D converters, DAC's, signal processors, memory for processing the audio signals, and wireless communication systems. The components frequently include multiple housings or shells that are connected to assemble the hearing aid.

Transducers, such as receivers (speakers) and microphones can have separate shells that are integrated with the device housing during assembly of the hearing aid. Receivers currently include a standard interface or spout that constrains the device design and implementation. Creating a connector scheme for receivers in custom products has been difficult if not impossible via traditional means because of the anatomical variations inherent in each impression. These variations do not permit the precise alignment and axial positioning required for repeatable performance.

What is needed in the art is an improved connector for hearing assistance devices.

SUMMARY

Disclosed herein, among other things, are methods and apparatus for hearing assistance devices, and in particular for improved connector for hearing assistance devices.

One aspect of the present subject matter relates to a hearing assistance system including a flex connector. A hearing assistance device housing includes hearing assistance electronics for a hearing assistance device. The system also includes a receiver configured to convert an electrical signal from the hearing assistance electronics to an acoustic signal. The receiver is configured to enable a quick connect and disconnect at various degrees on and off vertical axial alignment with repeatable reliability, according to various embodiments.

In one embodiment, a receiver module for a hearing aid includes a receiver, a receiver case, and a flex tab connector. The hearing aid includes a receptacle connector and circuitry connected to the receptacle connector. The receiver is configured to transmit sound to a user's ear canal and housed in the receiver case. The flex tab connector is electrically connected to the receiver and configured to mate with the receptacle connector to provide electrical connection between the receiver and the circuitry, and includes a flex substrate and conductive contacts constructed on the flex substrate.

In one embodiment, a hearing aid includes circuitry to process sounds, a shell housing the circuitry, and a receiver module. The receiver module includes a receiver configured to transmit the processed sounds and a bendable flex connector electrically connected to the receiver. The shell includes a cavity configured to accommodate at least a portion of the receiver module. A receptacle connector coupled to the shell and electrically connected to the circuitry. A receptacle connector is configured to mate with the flex connector of the receiver module to provide electrical connection between the receiver and the circuitry.

In one embodiment, a method for connecting a receiver module to hearing aid circuitry is provided. The receiver module includes a receiver. The hearing aid circuitry is housed in a hearing aid shell having a cavity shaped to accommodating at least a portion of the receiver module. The receiver module is provided with a first connector that is a bendable flex connector. A second connector is mounted to the shell to mate with the first connector to provide electrical connection between the receiver and the hearing aid circuitry.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

Disclosed herein, among other things, are methods and apparatus for hearing assistance devices, and in particular improved connectors for hearing assistance devices. One aspect of the present subject matter relates to a hearing assistance system including a flex connector. A hearing assistance device housing includes hearing assistance electronics for a hearing assistance device. The system also includes a receiver configured to convert an electrical signal from the hearing assistance electronics to an acoustic signal. The receiver is constructed as a receiver module configured to enable a quick connection to and disconnection from the main body of the hearing assistance device at various degrees on and off vertical axial alignment with repeatable reliability, according to various embodiments.

The present subject matter provides a new flex based connector system that meets the needs for improved connectors without severely limiting the options of the modeler. This flex connector system will enable on the fly customization of the connector resulting in savings of not only time but cost as well.

In one example, a male flex tab is used of varying length in the place of solder pads, and a female connector is made from a sculpted flex format with a laminated epoxy glass stiffener board engineered to provide the necessary spring force to ensure a repeatable and reliable connection. Various embodiments of the present subject matter are discussed as follows.

Figure 1:
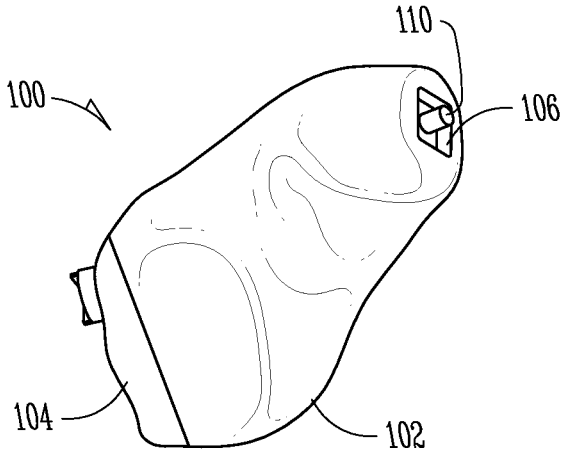
FIG. 1 is an illustration of an embodiment of a hearing aid including a detachably connected receiver module.

FIG. 1 is an illustration of an embodiment of a hearing aid 100. Hearing aid 100 includes a shell 102, a faceplate 104, a detachably connected receiver module 110, and a cavity 106 on shell 102. Cavity 102 is shaped to accommodate at least a portion of receiver module 110. In the illustrated embodiment, cavity 102 is shaped to accommodate a major portion of receiver module 110. In the illustrated embodiment, hearing aid 100 is a completely-in-canal (CIC) type hearing aid, with shell 102 having an irregular conical shape configured for the CIC type hearing aid. In various embodiments, hearing aid 100 is a custom fit hearing aid. In various other embodiments, receiver module 110 is used in a stand fit hearing aid. In various hearing aid designs, to improve performance of the hearing aid, it is beneficial to customize portions of the hearing aid to the hearing aid user. In some embodiments, shell 102 is customized to sealingly mate with the individual user's hearing canal. However, it should be understood that the present subject matter also includes standardized shells which are suitable for mating to an ear canal of the user.

In various embodiments, shell 102 includes a large opening configured for interfacing with faceplate 104. In various embodiments, this opening is of an irregular shape, requiring that the mating faceplate 104 be customized to fit to it. In various embodiments, a standard faceplate that is larger than the opening is fitted to shell 102, and then modified to a custom shape to form faceplate 104.

Figure 2:
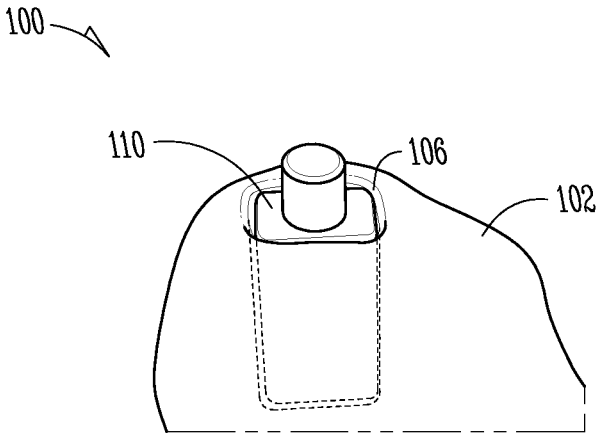
FIG. 2 is another illustration showing another view of the hearing aid of FIG. 1.

In various embodiments, hearing aid components housed in shell 102 include a microphone to receive a sound signal and a processing circuit to process the sound signal to produce an output sound signal. Receiver module 110 houses a receiver (speaker) that converts the output sound signal to a sound audible to the user and transmits that sound to the user's ear canal. In various embodiments, cavity 106 is formed on shell 102 to accommodate at least a portion of receiver module 110, allowing receiver module 110 to be detachably connected to the rest of hearing aid 100 through a connector mounted or otherwise coupled to shell 102 within cavity 106. Thus, receiver module 110 is replaceable. FIG. 2 is an illustration of portions of hearing aid 100 showing receiver module 110 accommodated in cavity 106 when connected to hearing aid 100. In one embodiment, the connection between receiver module 110 and the rest of hearing aid 100 is a mechanically flexible connection, as further discussed with reference to FIGS. 3-8, to facilitate customization of shell 102 and/or improve durability of the connection.

In various embodiments, hearing aid 100 may include additional hearing aid components. In various embodiments, shell 102 houses a hearing aid circuitry including the microphone, processing circuitry, and optionally the additional hearing aid circuitry. In some embodiments, the hearing aid circuitry is constructed as a flex circuit including hearing aid components mounted on a flex substrate that is bendable. In various embodiments, common parts suitable for interface with faceplate 104 include a microphone housing, an insertion removal handle, a cover, and a battery. In further embodiments, faceplate 104 is configured to utilize various controls, such as adjusting dials and push-button switches. In various embodiments, hearing aid 100 provides the user with comfort due to its customized shape, and flexibility and/or durability due to the use of the detachably connected receiver module 110.

Figure 3:
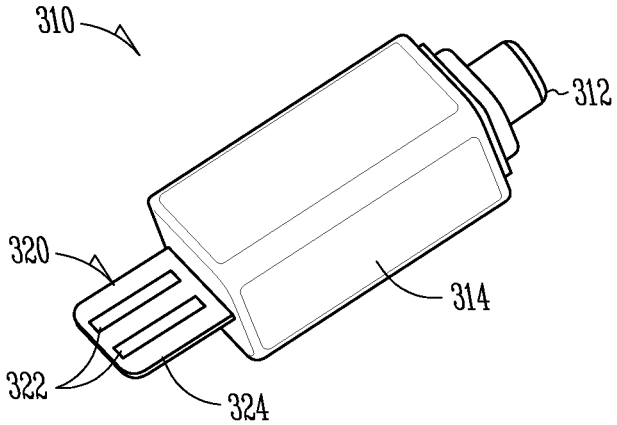
FIG. 3 is an illustration of an embodiment of the receiver module.

FIG. 3 is an illustration of an embodiment of a receiver module 310. Receiver module 310 represents an embodiment of receiver module 110 and includes a receiver assembly 312 coupled to a flex tab connector 320. In various embodiments, receiver assembly 312 includes at least the receiver that transmits sounds to the user's ear canal, and may include a receiver case that houses at least a portion of the receiver. In the illustrated embodiment, receiver module 310 includes a sleeve 314 accommodating a major portion of receiver assembly 312. In one example, sleeve 314 is an isolation sleeve made of a polymer such as silicone.

Flex tab connector 320 is a bendable flex connector (also known as, for example, flexible connector, flex circuit connector, or flexible circuit connector) including conductive contacts 322 constructed on a flex substrate 324 (also known as flexible substrate, flex circuit substrate, or flexible circuit substrate). With conductive contacts (flex pads) 322 made of mechanically flexible conductive traces such as copper traces, connector 320 is substantially bendable. Use of connector 320 with in-line flex conductive contacts 322 eliminates the need for solder pads for connecting the receiver assembly to the processing circuit of hearing aid 100. In various embodiments, flex tab connector 320 has advantages over a rigid connector because, for example, it facilitates customization of the length of receiver module 310 and hence hearing aid 100, allows for off-axis connector alignment, protects the receiver from heat during soldering (when solder pads are used), and provides for self-alignment for a blind insertion of hearing aid 100 into the user's ear canal. In one embodiment, conductive contacts 322 are constructed on both sides of substrate 324. In one embodiment, duplication of the conductive contacts on both sides of the substrate provides fault free insurance of connection. In various embodiments, use of flex tab connector 320 eliminates wall stack-up, thereby permitting greater flexibility in vent type and placement in almost all circumstances for CIC type hearing aids.

Figure 4:
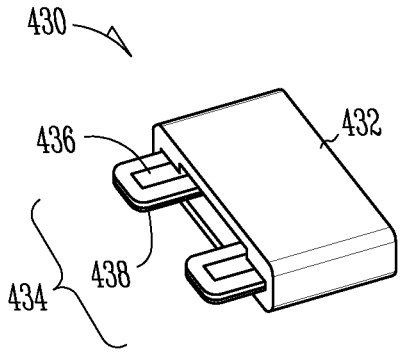
FIG. 4 is an illustration of an embodiment of a receptacle connector assembly for mating with the receiver module.
Figure 5:
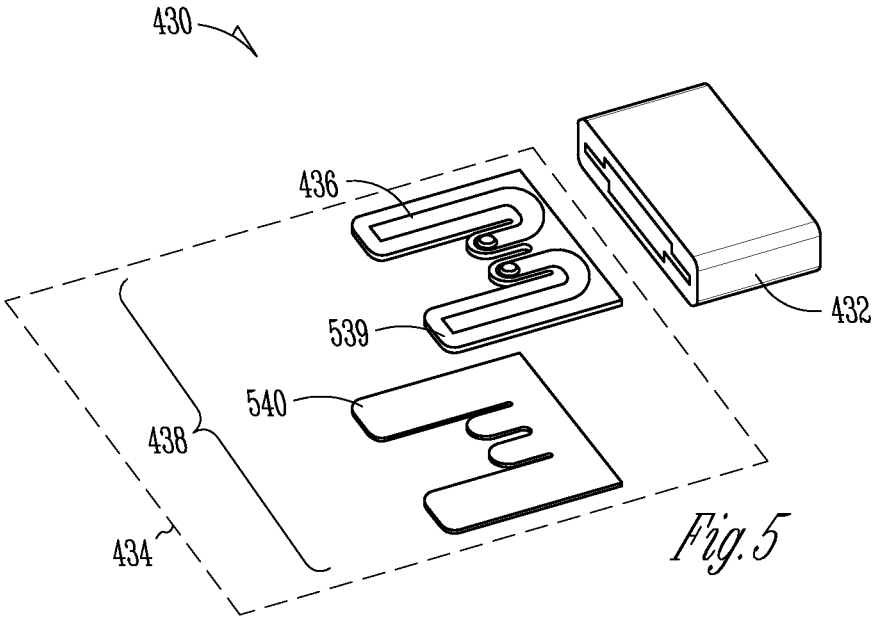
FIG. 5 is an assembly diagram illustrating an embodiment of the receptacle connector assembly of FIG. 4.

FIG. 4 is an illustration of an embodiment of a receptacle connector assembly 430 for mating with receiver module 310, and FIG. 5 is an assembly diagram illustrating an embodiment of receptacle connector assembly 430 showing its unassembled components. Receptacle connector assembly 430 functions as a receptacle connector for connector 320. In the illustrated embodiment, connector 320 is configured as a male connector, while connector assembly 430 is configured as a female connector.

Receptacle connector assembly 430 is configured to mate with connector 320. In the illustrated embodiment, connector assembly 430 includes a connector 434 and a connector housing 432. In one embodiment, connector 434 is a bendable flex connector. Connector housing 432 is made of an elastic material, such as a polymer, and configured to accommodate at least a portion of connector 434. Thus, receptacle connector assembly 430 is bendable. Connector 434 includes conductive contacts 436 constructed on a bendable flex substrate 438. In one embodiment, flex substrate 438 includes a contact layer 539 and a stiffener layer 540 to achiever a desired level of flexibility. Contact layer 539 may include s polyimide film, and stiffener layer 540 may include a glass-reinforced epoxy laminate sheet. For example, contact layer 539 may include a 0.07 millimeter Kapton film, and stiffener layer 540 may include a 0.13 millimeter FR4 type stiffener, thereby providing for a 0.2 millimeter-thick substrate 438. Such a structure creates the necessary contact spring force in a substrate with a thin cross-section. In some embodiments, connector housing 432 is not needed as connector 434 could be built into a structure of hearing aid 100 such as a spine or faceplate 104. When stand-alone use (without other physical support mechanism) is desired, connector housing 432 is configured to provide for a mounting structure and opposition force (when such structure and force are not available from the spine or faceplate, for example). In some embodiments, connector 434 can be leveraged into an ultra thin stand alone programming module or be built into the master flex board of hearing aid 100. The master flex board is a flex circuit board on which at least a portion of the hearing aid circuitry is constructed. In one embodiment, at least a major portion of the hearing aid circuitry is constructed on the master flex board.

Figure 6:
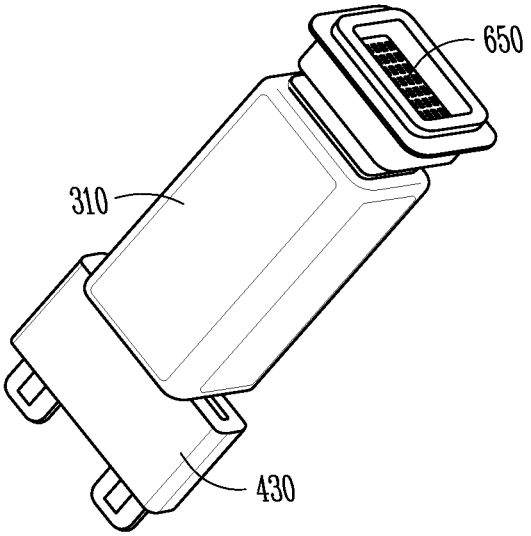
FIG. 6 is an illustration of an embodiment of a receiver module assembly.

FIG. 6 is an illustration of an embodiment of a receiver module assembly that constitutes part of hearing aid 100 and includes receiver module 310 connected with connector 430. In the illustrated embodiment, receiver module 310 is also connected to a receiver cover 650, which is configured to mate with cavity 106 at its opening. In various embodiments, receiver cover 650 protects the receiver from unwanted materials such as earwax and moisture that may present in the ear canal of the user, while allowing sounds to pass, during operation of hearing aid 100.

Receiver module 310 allows placement of the receiver of hearing aid 100 deep into the ear canal, minimizes casing time, and is easily replaceable in field or in house. In one embodiment, receiver module 310 is configured to fit into a CIC type hearing aid with a minimum cross-section of 3.8 $mm^2$ and a minimum acoustic gain of 60 dB.

Figure 7:
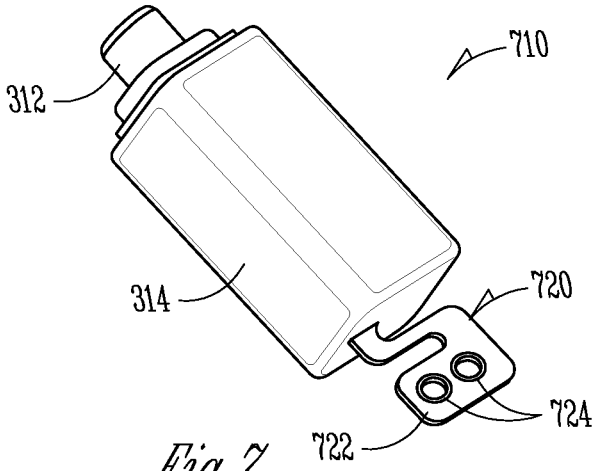
FIG. 7 is an illustration of another embodiment of the receiver module.

FIG. 7 is an illustration of an embodiment of a receiver module 710. Receiver module 710 includes receiver assembly 312, sleeve 314, and a flex tab connector 720. Receiver module 710 represents an embodiment of receiver module 310 with connector 720 being an example of a variation of connector 310. In the illustrated embodiment, receiver module 710 is substantially similar or identical to receiver module 310 except for that connector 720 is configured for use in a behind-the-ear (BTE) type hearing aid that includes a detachably connected receiver module that is to be placed in the ear canal of the user. Connector 720 is a bendable flex connector including conductive contacts 722 on a flex substrate 724. Conductive contacts 724 are configured as pin locators to ensure a non-biased suspension when used with tube/spout suspension in the BTE type hearing aid. In various embodiments, finite element analysis (FEA) modeling can be used to match cutout suspension to stiffness of the tube.

Figure 8:
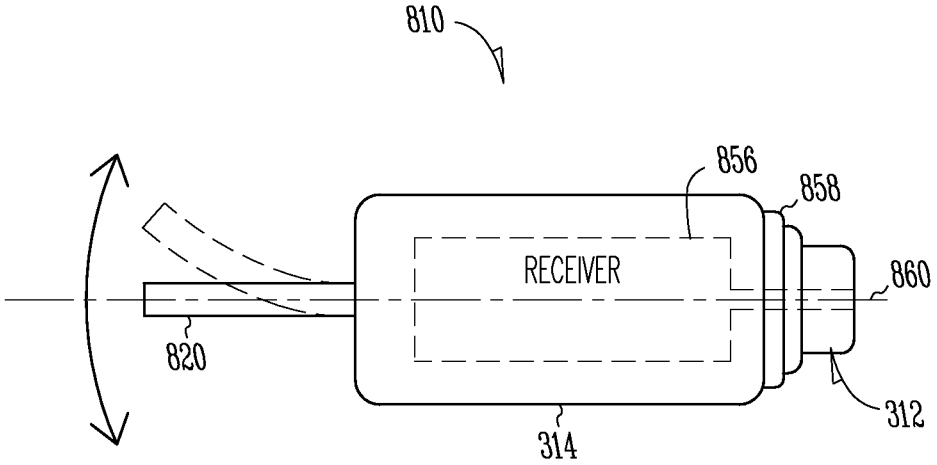
FIG. 8 is a diagram illustrating an embodiment of the receiver module showing flexibility of its flex connector.

FIG. 8 is a diagram illustrating an embodiment of a receiver module 810 (in a side view showing thickness of a flex tab connector) showing its connection flexibility. Receiver module 810 represents any receiver module designed according to the present subject matter as discussed in this document, including receiver modules 310 and 710 as examples. Receiver module 810 has a long axis 860 and includes receiver assembly 312, optionally sleeve 314, and flex tab connector 820. Receiver assembly 312 includes a receiver 856 and a receiver case 858 housing receiver 856 or a portion thereof. Connector 820 represents any flex connector of the receiver module designed according to the present subject matter as discussed in this document, including connectors 320 and 720 as examples. In the illustrated embodiment, connector 820 is bendable from axis 860. In one embodiment, connector 820, or a major portion thereof, is on axis 860 when it is in an unconstrained state (e.g., not connected). In other embodiments, at least a portion of connector 820 is off axis 860 when it is in the unconstrained state, if desired based on various design considerations. In various embodiments, in addition to being bendable from axis 860, connector 820 is also bendable about axis 860 to certain degree. In various embodiments, connector 820 has the mechanical characteristics of a flex circuit as known in the electronics art. In various embodiments, connect 820 provides receiver module 810 with ability of a quick connection and disconnection with the rest of the hearing aid at various degrees on and off vertical axial alignment (i.e., alignment with axis 860) with repeatable reliability.

In various embodiments, the present subject matter provides hearing aids with shortened build cycles, reduced touch points, quicker repair, fewer reprints of shells as the receiver module is replaceable, and "plug-and-play" receiver module selection (with less modeling), while not reducing number of options for or styles of vents.

It is understood that variations in communications protocols, antenna configurations, and combinations of components may be employed without departing from the scope of the present subject matter. Hearing assistance devices typically include an enclosure or housing, a microphone, hearing assistance device electronics including processing electronics, and a speaker or receiver. It is understood that in various embodiments the microphone is optional. It is understood that in various embodiments the receiver is optional. Antenna configurations may vary and may be included within an enclosure for the electronics or be external to an enclosure for the electronics. Thus, the examples set forth herein are intended to be demonstrative and not a limiting or exhaustive depiction of variations.

The present subject matter can be used for a variety of hearing assistance devices, including but not limited to, cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user. Such devices are also known as receiver-in-the-canal (RIC) or receiver-in-the-ear (RITE) hearing instruments. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A receiver module for a hearing aid, the hearing aid including a receptacle connector and circuitry electrically connected to the receptacle connector, the receiver module comprising:

a receiver configured to transmit sound;

a receiver case housing the receiver; and a flex tab connector coupled to the receiver case and electrically connected to the receiver, the flex tab connector configured to detachably mate with and electrically connect to the receptacle connector to provide electrical connection between the receiver and the circuitry and including a flex substrate and conductive contacts on the flex substrate.

2. The receiver module of claim 1, wherein the conductive contacts are duplicated on both sides of the flex substrate.

3. The receiver module of claim 2, wherein flex tab connector comprises a male connector.

4. The receiver module of claim 1, comprising a long axis, and wherein the flex tab connector is bendable from the long axis.

5. The receiver module of claim 4, wherein the flex tab connector is further bendable about the long axis.

6. The receiver module of claim 4, wherein the flex tab connector is on the long axis when being in an unconstrained state.

7. The receiver module of claim 4, wherein the flex tab connector is off the long axis when being in an unconstrained state.

8. A hearing aid including circuitry to process sounds, the hearing aid comprising:

a receiver module including a receiver configured to transmit the processed sounds and a bendable first flex connector electrically connected to the receiver;

a shell housing the circuitry, the shell including a cavity configured to accommodate at least a portion of the receiver module;

a second connector electrically connected to the circuitry, the second connector configured to detachably mate with and electrically connected to the first flex connector to provide electrical connection between the receiver and the circuitry; and a connector housing mounted to the shell and accommodating at least a portion of the second connector.

9. The hearing aid of claim 8, wherein the first flex connector comprises a first flex substrate and conductive contacts disposed on the first flex substrate.

10. The hearing aid of claim 9, wherein the conductive contacts are disposed on both sides of the flex substrate.

11. The hearing aid of claim 9, wherein the first flex connector is configured to be a male connector.

12. The hearing aid of claim 9, wherein the shell is configured for a completely-in-canal (CIC) hearing aid.

13. The hearing aid of claim 12, wherein the shell is configured for a custom fit hearing aid.

14. The hearing aid of claim 8, wherein the second connector comprises a bendable second flex connector including a second flex substrate and second conductive contacts disposed on the second flex substrate.

15. The hearing aid of claim 14, wherein the second flex substrate comprises a contact layer and a stiffener layer.

16. The hearing aid of claim 15, wherein the connector housing is made of an elastic material.

17. A method for connecting a receiver module including a receive hearing aid circuitry housed in a hearing aid shell having a cavity shaped to accommodate at least a portion of the receiver module, the method comprising:

providing the receiver module with a first connector being a bendable flex connector electrically connected to the receiver;

connecting a second connector to the hearing aid circuitry; and mounting the second connector to the shell to allow the second connector to detachably mate with and electrically connected to the first connector to provide electrical connection between the receiver and the hearing aid circuitry.

18. The method of claim 17, comprising constructing the bendable flex connector, including:

providing a bendable first flex substrate; and constructing first conductive contacts on the first flex substrate.

19. The method of claim 18, wherein constructing the first conductive contacts onto the first flex substrate comprises constructing the first conductive contacts onto both sides of the first flex substrate.

20. The method of claim 18, wherein mounting the second connector to the shell comprises mounding a bendable second flex connector to the shell, and comprising constructing the bendable second flex connector, including:

providing a bendable second flex substrate; and constructing second conductive contacts on the second flex substrate.

21. The method of claim 20, wherein providing the bendable second flex substrate comprises providing a substrate with a contact layer on a stiffener layer.

22. The method of claim 21, further comprising providing a polymer housing to accommodate at least a portion of the second flex connector, and wherein mounting the second connector to the shell comprises using the polymer housing as a mounting structure.

* * * * *